US010895820B2

(12) United States Patent
Takao

(10) Patent No.: US 10,895,820 B2
(45) Date of Patent: Jan. 19, 2021

(54) PULSE SIGNAL GENERATION CIRCUIT AND IMAGE FORMING APPARATUS INCLUDING THE SAME

(71) Applicant: CANON KABUSHIKI KAISHA, Tokyo (JP)

(72) Inventor: Yoshifumi Takao, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/740,247

(22) Filed: Jan. 10, 2020

(65) Prior Publication Data

US 2020/0233331 A1 Jul. 23, 2020

(30) Foreign Application Priority Data

Jan. 18, 2019 (JP) ..... 2019-007378

(51) Int. Cl.
*G03G 15/043* (2006.01)

(52) U.S. Cl.
CPC ..... *G03G 15/043* (2013.01)

(58) Field of Classification Search
CPC ... G03G 15/043; G03G 15/04; G03G 2215/04
See application file for complete search history.

(56) References Cited

U.S. PATENT DOCUMENTS

2016/0147171 A1* 5/2016 Ishida ..... G03G 15/043 347/118
2017/0331973 A1* 11/2017 Takeda ..... H04N 1/1937

FOREIGN PATENT DOCUMENTS

JP 2005-178041 A 7/2005

* cited by examiner

*Primary Examiner* — Sandra Brase
(74) *Attorney, Agent, or Firm* — Canon U.S.A., Inc. I.P. Division

(57) ABSTRACT

There is provided a pulse signal generation circuit capable of generating a high-resolution pulse signal by generating pattern data by performing a logical operation on rising data that indicates the rising of a pulse signal and falling data that indicates the falling of the pulse signal.

3 Claims, 18 Drawing Sheets

FIG.8

530

| PATTERN DATA | DECODING TABLE | | | | | | | | | | | | | | | |
|---|---|---|---|---|---|---|---|---|---|---|---|---|---|---|---|---|
| 0h | 1 | 1 | 1 | 1 | 1 | 1 | 1 | 1 | 1 | 1 | 1 | 1 | 1 | 1 | 1 | 1 |
| 1h | 1 | 1 | 1 | 1 | 1 | 1 | 1 | 1 | 1 | 1 | 1 | 1 | 1 | 1 | 1 | 0 |
| 2h | 1 | 1 | 1 | 1 | 1 | 1 | 1 | 1 | 1 | 1 | 1 | 1 | 1 | 1 | 0 | 0 |
| 3h | 1 | 1 | 1 | 1 | 1 | 1 | 1 | 1 | 1 | 1 | 1 | 1 | 1 | 0 | 0 | 0 |
| 4h | 1 | 1 | 1 | 1 | 1 | 1 | 1 | 1 | 1 | 1 | 1 | 1 | 0 | 0 | 0 | 0 |
| 5h | 1 | 1 | 1 | 1 | 1 | 1 | 1 | 1 | 1 | 1 | 1 | 0 | 0 | 0 | 0 | 0 |
| 6h | 1 | 1 | 1 | 1 | 1 | 1 | 1 | 1 | 1 | 1 | 0 | 0 | 0 | 0 | 0 | 0 |
| 7h | 1 | 1 | 1 | 1 | 1 | 1 | 1 | 1 | 1 | 0 | 0 | 0 | 0 | 0 | 0 | 0 |
| 8h | 1 | 1 | 1 | 1 | 1 | 1 | 1 | 1 | 0 | 0 | 0 | 0 | 0 | 0 | 0 | 0 |
| 9h | 1 | 1 | 1 | 1 | 1 | 1 | 1 | 0 | 0 | 0 | 0 | 0 | 0 | 0 | 0 | 0 |
| Ah | 1 | 1 | 1 | 1 | 1 | 1 | 0 | 0 | 0 | 0 | 0 | 0 | 0 | 0 | 0 | 0 |
| Bh | 1 | 1 | 1 | 1 | 1 | 0 | 0 | 0 | 0 | 0 | 0 | 0 | 0 | 0 | 0 | 0 |
| Ch | 1 | 1 | 1 | 1 | 0 | 0 | 0 | 0 | 0 | 0 | 0 | 0 | 0 | 0 | 0 | 0 |
| Dh | 1 | 1 | 1 | 0 | 0 | 0 | 0 | 0 | 0 | 0 | 0 | 0 | 0 | 0 | 0 | 0 |
| Eh | 1 | 1 | 0 | 0 | 0 | 0 | 0 | 0 | 0 | 0 | 0 | 0 | 0 | 0 | 0 | 0 |
| Fh | 1 | 0 | 0 | 0 | 0 | 0 | 0 | 0 | 0 | 0 | 0 | 0 | 0 | 0 | 0 | 0 |

PULSE SIGNAL GENERATION CIRCUIT AND IMAGE FORMING APPARATUS INCLUDING THE SAME

BACKGROUND

Field

The present disclosure relates to a method for generating a pulse width modulation (PWM) signal.

Description of the Related Art

In an image forming apparatus, a reference voltage is needed for laser light control for exposing a photosensitive member thereto, motor control, and feedback control using a sensor. To generate the reference voltage, a digital-analog converter (DAC) is used. In particular, a digital-analog (DA) conversion that converts a digital signal to an analog signal by passing a pulse width modulation (PWM) signal through a low-pass filter (LPF) including a resistance R and a capacitor C is known (see, Japanese Patent Application Laid-Open No. 2005-178041). The DA conversion process using a PWM signal enables the output voltage corresponding to the pulse width of a PWM signal to be generated by a simple configuration and is therefore broadly used in image forming apparatuses.

One example of an integrated circuit (hereinafter, referred to IC) that outputs a PWM signal is an application-specific integrated circuit (ASIC) obtained by integrating a central processing unit (CPU) and functional modules into one chip. The IC is provided with a configuration to operate an internal counter and compare the count value of the counter with a setting value. The IC then outputs a pulse having a width corresponding to the setting value by switching between high and low (Hi/Lo) output levels at a timing at which the count value coincides with the setting value. Calculation in the IC and the pulse output are performed in synchronization with a reference clock (CLK) that is input to the CPU or the ASIC. In an image forming apparatus, higher levels of responsiveness and resolution have been demanded for DA conversion in association with increase in process speed.

SUMMARY

According to various embodiments of the present disclosure, a pulse signal generation circuit generates a pulse signal. The pulse signal generation circuit includes a pattern generation unit configured to generate, as a first bit pattern, rising data, indicating rising of the pulse signal, and falling data, indicating falling of the pulse signal, wherein each of the rising data and the falling data of the first bit pattern includes a plurality of pieces of bit data, and generate a second bit pattern, including a plurality of pieces of bit data, by performing a logical operation using the rising data and the falling data, a clock signal generation unit configured to generate a clock signal, and a shift register configured to have the second bit pattern set therein, the second bit pattern generated by the pattern generation unit, wherein the pulse signal is generated by the shift register outputting pattern data of the second bit pattern, one bit at a time in synchronization with the clock signal.

Further features will become apparent from the following description of exemplary embodiments with reference to the attached drawings.

BRIEF DESCRIPTION OF THE DRAWINGS

FIG. 8 is a phase data decoding table.

DESCRIPTION OF THE EMBODIMENTS

<Image Forming Apparatus>

Figure 1:
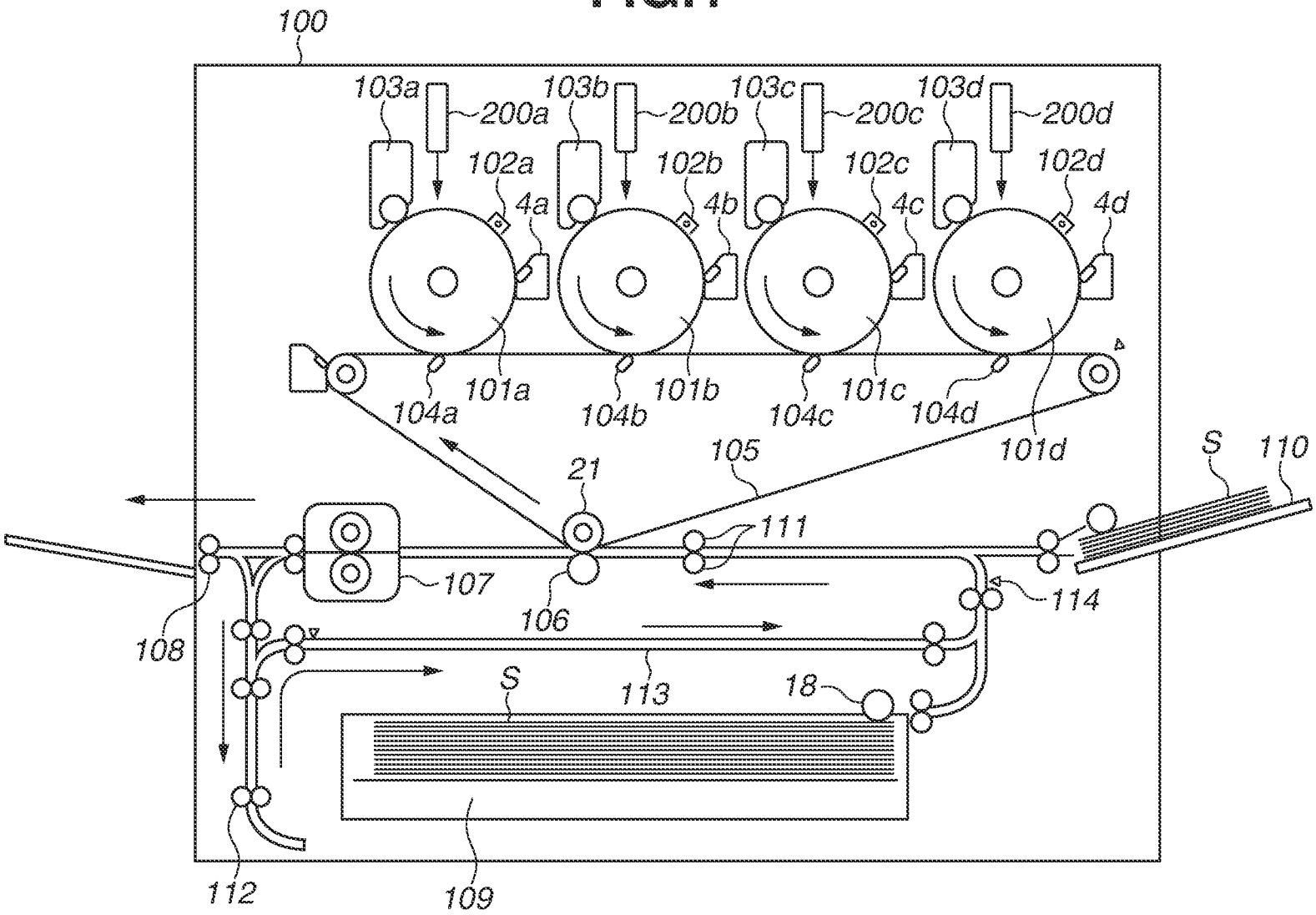
FIG. 1 is a sectional diagram illustrating an image forming apparatus.

FIG. 1 is a sectional diagram illustrating an entire configuration of an image forming apparatus 100 according to a first exemplary embodiment and illustrates a schematic configuration of an electrophotographic full-color printer. In the image forming apparatus 100 illustrated in FIG. 1, photosensitive drums 101*a* to 101*d* serving as photosensitive members corresponding to individual colors (yellow, magenta, cyan, and black) are electrostatically charged respectively by charging devices 102*a* to 102*d*. After being electrostatically charged, the photosensitive drums 101*a* to 101*d* are exposed to laser light (light beams) emitted from laser scanner units 200*a* to 200*d* (optical scanning devices) that use laser emitting devices as light sources. Each of the photosensitive drums is exposed to laser light to have an electrostatic latent image formed thereon. Respective development devices 103*a* to 103*d* corresponding to the individual colors develop electrostatic latent images on the corresponding photosensitive drums 101*a* to 101*d* using toner. The respective toner images of the colors developed on the photosensitive drums 101*a* to 101*d* are transferred onto an intermediate transfer belt 105 with transfer biases applied to the transfer blades 104*a* to 104*d*. The toner images that have not been transferred to the intermediate transfer belt 105 are removed by the photosensitive drum cleaners 4*a* to 4*d* because untransferred toner images may cause image contamination. The toner images of the four colors transferred onto the intermediate transfer belt 105 are collectively transferred onto a recording sheet S by the secondary transfer roller 106. The recording sheet S bearing the toner images thereon passes through a fixing device 107 to have a fixing process performed thereon and is then discharged to the outside of the image forming apparatus 100 by a discharge roller 108.

The above-described recording sheet S is fed from a paper cassette 109 or a manual feed tray 110 and conveyed to the secondary transfer roller 106 and the secondary transfer inner roller 21 after the registration roller 111 adjusts a timing for conveying the recording sheet S. For double-sided printing, the recording sheet S that has passed through the fixing device 107 is guided to a double-side reversing path 112 to be reversed, and then conveyed to a double-side path 113. The recording sheet S that has passed through the double-side path 113 passes through vertical path rollers 114 again. The recording sheet S is then discharged after an image for the second side is formed, transferred, and fixed in the same manner as for the first side. A copy can be obtained through the above operation.

<Laser Scanner Unit>

Figure 2:
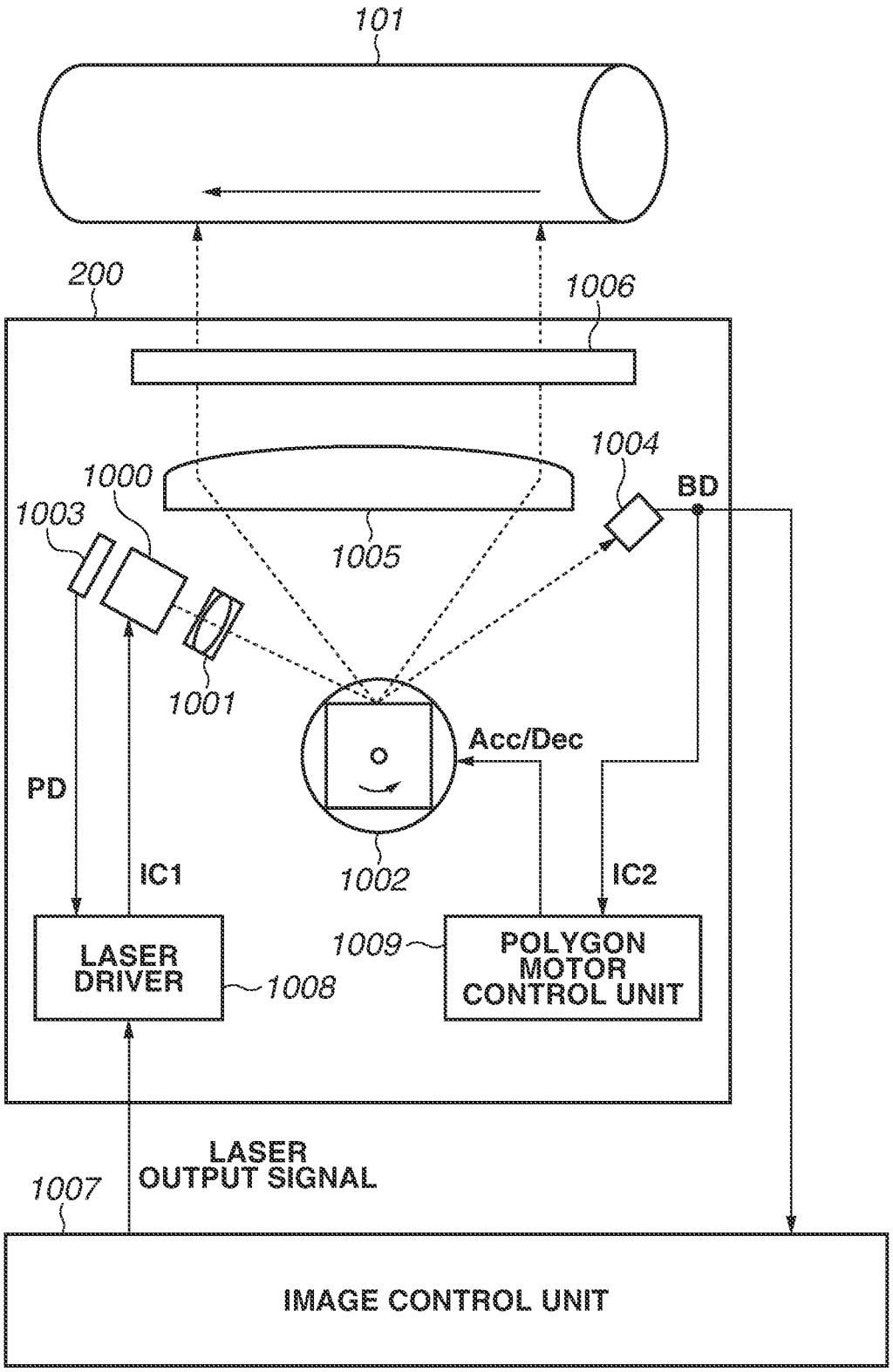
FIG. 2 is a block diagram illustrating a configuration of a laser unit.

Operation of a laser scanner unit 200 and an image control unit is will be described in detail with reference to FIG. 2. In this example, a central processing unit (CPU), which is not illustrated, controls these control units.

A laser light source 1000 in the present exemplary embodiment is an edge emitting type semiconductor laser and a laser element included therein emits laser light in two directions. The laser light source 1000 includes a photodiode (PD) 1003. Laser light that is emitted from the laser element in one direction enters the photodiode (PD) 1003. The PD 1003 outputs electric current corresponding to the entered light. This electric current is converted into a voltage (referred to as PD signal) by a fixed resistance (not illustrated). The PD signal is input to a laser driver 1008. The laser driver 1008 executes automatic power control (APC) in which laser light emitted by the laser light source 1000 is controlled based on the PD signal.

Laser light that is emitted from the laser element in the other direction passes through a collimator lens 1001 to be converged laser light and enters a reflection surface of a polygon mirror 1002 (rotatable polygon mirror). A polygon motor control unit 1009 outputs a drive signal (Acc/Dec) to a polygon motor (not illustrated). Upon receiving the drive signal, the polygon motor drives the polygon mirror 1002 to rotate. As a result, laser light deflected by the reflection surface of the polygon mirror 1002 scans the photosensitive drum 101. This laser light also scans a beam detect (hereinafter, referred to BD) sensor 1004. The BD sensor 1004 outputs a BD signal by being scanned by the laser light. This BD signal is input to the polygon motor control unit 1009 and subjected to feedback control so that the polygon mirror 1002 can stably rotate in desired cycles.

When the BD signal generation cycle has converged in a range of a target cycle, an image control unit 1007 determines that the polygon mirror 1002 has reached a target speed and is stably rotating at the target speed appropriate for executing image formation. When the polygon mirror 1002 is stably rotating, the image control unit 1007 generates a timing signal (top-of-page (TOP) signal) for the start of image drawing. When the TOP signal is generated, the image control unit 1007 starts outputting to the laser driver 1008, in synchronization with the TOP signal, image data that has been subjected to a correction process corresponding to each of the reflection surfaces of the polygon mirror 1002. The laser driver 1008 drives the laser light source 1000 based on the input image data. As a result, laser light for forming an image on the photosensitive drum 101 is generated. Laser light driven to be ON/OFF passes through an F-θ lens 1005, and corrected from the scanning with a constant angular speed on the polygon mirror 1002 to the scanning with a constant speed on the photosensitive drum 101. The corrected laser light forms an electrostatic latent image on the photosensitive drum 101 via a folding mirror 1006. A shading circuit described below may be included in the laser driver 1008. Alternatively, the shading circuit may be provided, separately from the laser driver 1008, as a discrete component on the same circuit board as the laser driver 1008, and be configured to electrically act on the laser driver 1008 so that an electric current value output by the laser driver 1008 to the laser light source 1000 can change.

Now, the amount of laser light that scans the photosensitive drum 101 in the present exemplary embodiment and laser light amount control are described. When the amount of laser light that is emitted from the laser light source 1000 is set constant, the amount of laser light that reaches the surface of the photosensitive drum 101 fluctuates depending on the optical performance of the laser scanner unit 200. For example, the amount of laser light on the surface of the photosensitive drum 101 is non-uniform with the reason that a characteristic of the F-θ lens 1005 is not uniform during the scanning or that laser light that scans have different optical path lengths at different scanning positions. If such non-uniformity in amount of laser light in the main scanning direction is not corrected, the density of a resulting image is non-uniform in the main scanning direction of laser light.

Thus, in order to make the amount of laser light that reaches the surface of the photosensitive drum 101 substantially uniform, correction of the amount of laser light (hereinafter, shading correction) is performed based on scanning positions of the laser light in the main scanning direction. Correction data to be used for executing shading correction is, for example, stored as a shading correction table for each of the laser scanner units 200 in a memory 501. Shading correction is executed based on the correction table stored in the memory 501.

Figure 3:
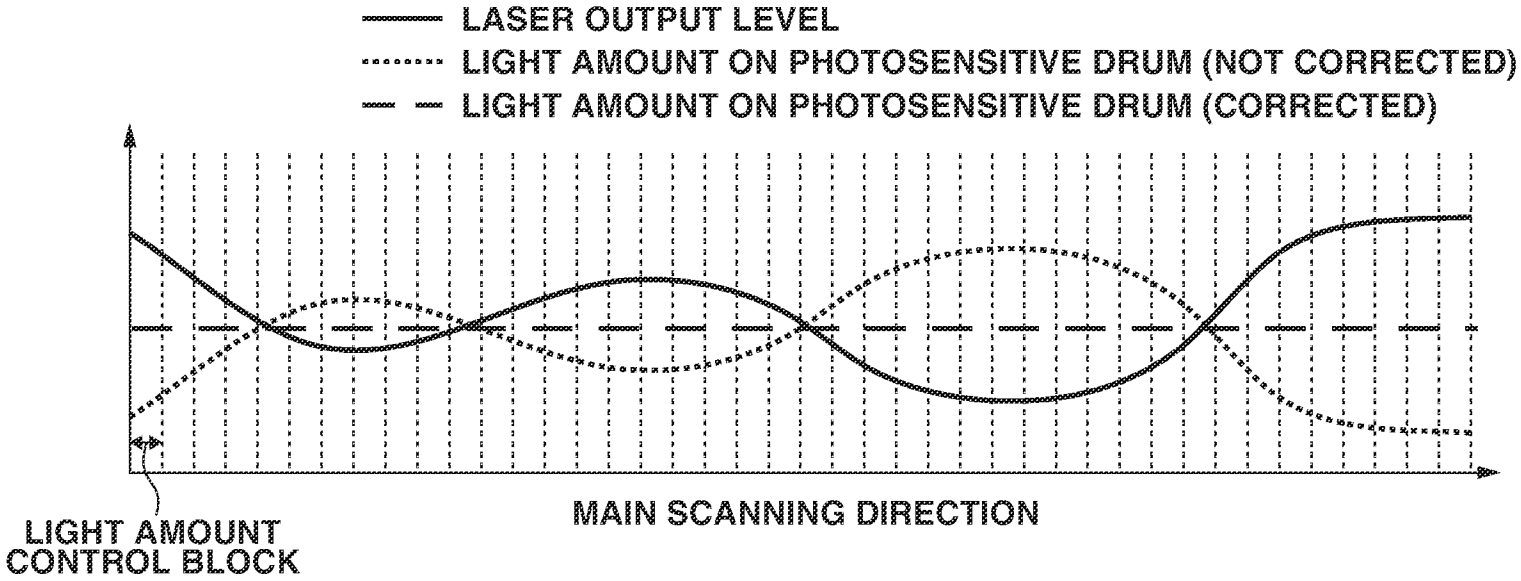
FIG. 3 is a graph illustrating shading of laser output.

FIG. 3 is a diagram schematically illustrating the shading correction. The vertical broken lines illustrated in FIG. 3 indicate boundaries between adjacent light amount control blocks (segments) used when shading correction is executed. Accordingly, each region between adjacent vertical broken lines illustrated in FIG. 3 is one block. The respective widths of the light amount control blocks may be uniform among all the blocks or may be varied based on the optical performance of the laser scanner unit 200.

The above memory 501 holds, as the correction table, the correction data set for each block. The image control unit 1007 outputs laser an output control voltage Vrefl calculated from the correction table for laser light based on scanning positions of the laser light in the main scanning direction. The laser output control voltage Vrefl is input to the laser driver 1008. Based on the laser output control voltage Vrefl, the laser driver 1008 controls the value of electric current to be supplied to the laser light source 1000. The laser light source 1000 outputs laser light of an amount corresponding to that of the electric current supplied by the laser driver 1008. In this manner, the amount of laser light that reaches the surface of the photosensitive drum 101 can be changed as desired based on positions exposed to laser light in the main scanning direction.

The thin dotted-line curve illustrated in FIG. 3 running across the blocks indicates change in amount of laser light that reaches the photosensitive drum 101 when shading correction is not executed. On the other hand, for example, when correction as indicated by the solid-line curve running across the blocks is applied to the amount of laser light as illustrated in FIG. 3, the amount of laser light that reaches the surface of the photosensitive drum 101 is made substantially uniform as indicated by the long and thick dotted line. The change in amount of laser light as indicated by the solid-line curve running across the blocks can be generated by the image control unit 1007 performing calculation using linear interpolation based on the correction data set for each of the blocks and the coordinates of exposure positions in each of the blocks.

Figure 4:
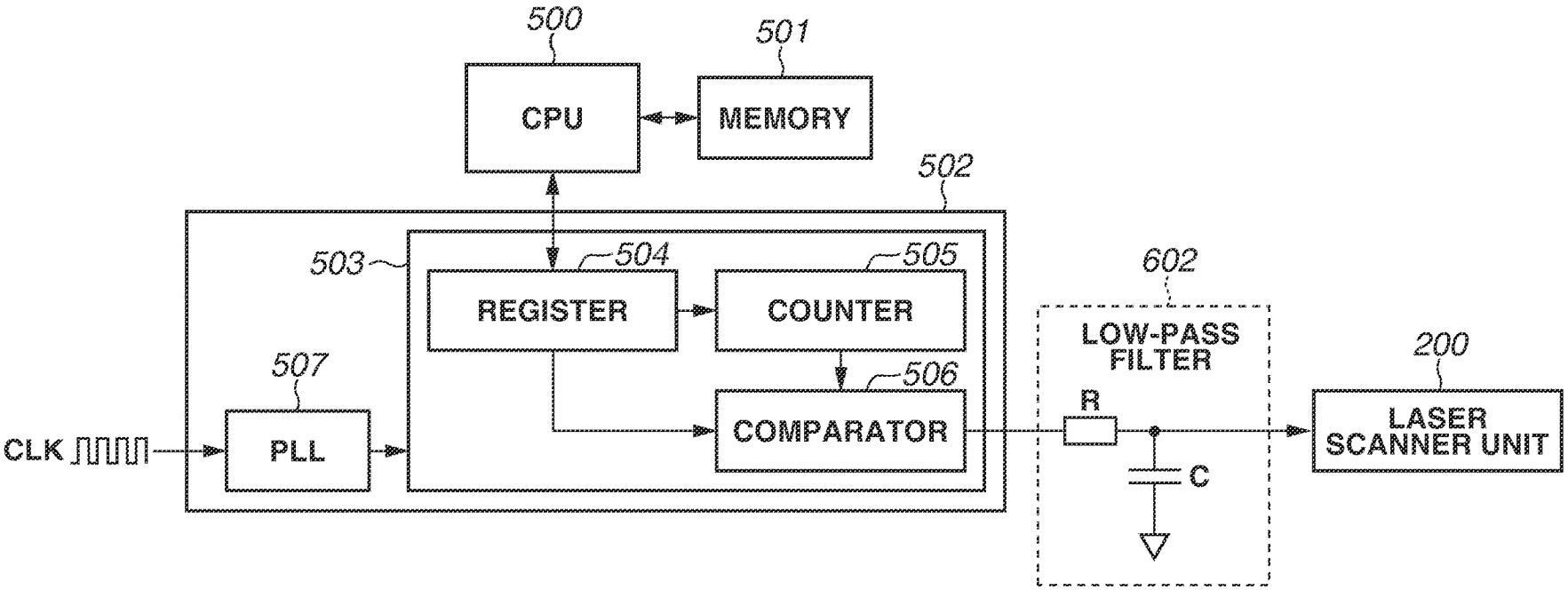
FIG. 4 is a block diagram illustrating an example of a configuration for obtaining a pulse width modulation (PWM) signal and a reference voltage.
Figure 5:
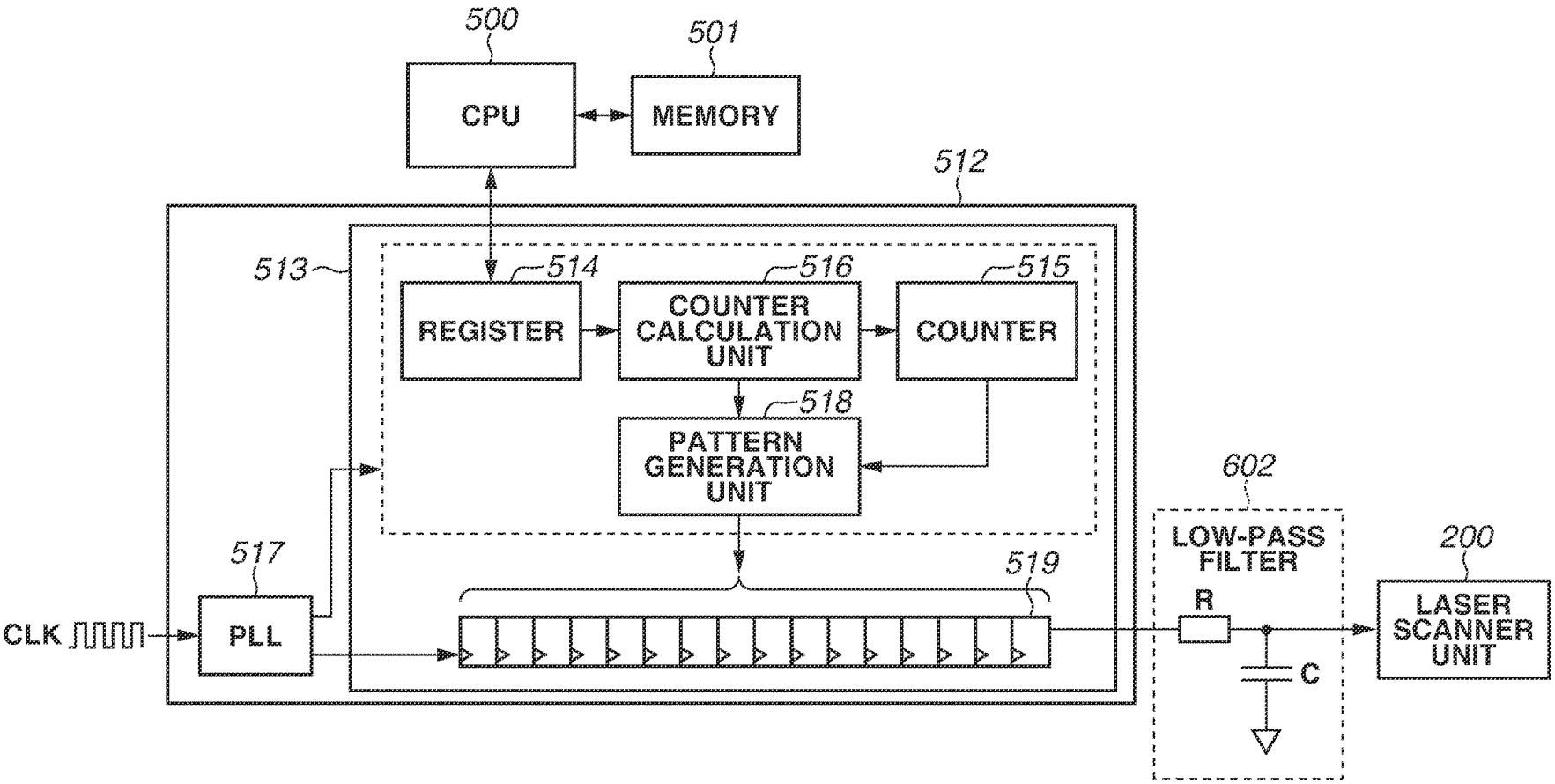
FIG. 5 is a block diagram illustrating an example of a configuration for obtaining a PWM output and a reference voltage.

The laser output control voltage Vrefl generated by the image control unit 1007 is described with reference to FIGS. 4 and 5. To generate the laser output control voltage Vrefl, an image forming apparatus may be provided with a digital-analogue converter (DAC) that uses a PWM signal and a low-pass filter 602 (i.e., smoothing circuit; hereinafter, LPF). FIG. 4 illustrates a circuit configuration for a conventional image forming apparatus. An integrated circuit (IC) 502 includes a pulse width modulation (PWM) signal generation unit 503. The PWM signal generation unit 503 includes a register 504, a clock (CLK) synchronization counter 505, and a comparator 506. The output PWM cycle, ON times, OFF times, or the like can be set to the register 504. The comparator 506 generates PWM output level switching timings. The PWM signal generation unit 503 has a synchronous circuit configuration. The PWM signal generation unit 503 in FIG. 4 has a configuration operating in CLK synchronization with a CLK obtained by a phase-lock loop (PLL) circuit 507 multiplying an externally input CLK. In the present exemplary embodiment, a low-speed CLK is a clock signal generated from a crystal oscillator and having a constant frequency, and a high-speed CLK is a clock signal obtained by the PLL circuit 517 (i.e., clock signal generation unit) performing a multiplication process on the low-speed CLK.

There is a conventional image forming apparatus in which the scanning speed of laser light is set at a high speed so that the image formation productivity can be improved. For such an image forming apparatus to execute highly accurate shading correction, the resolution of the laser output control voltage Vrefl for each light amount control block needs to be higher than that corresponding to at least the number of divisions of each light amount control block. As the scanning speed is higher, the scanning time for each light amount control block becomes shorter. As a result, the control time to be usable for each light amount control block becomes shorter, and the resolution of light amount control accordingly needs to be increased by, for example, increasing the speed of a CLK for generating a PWM.

The speed of a CLK can be increased, for example, by providing a PLL circuit in an integrated circuit and multiplying a CLK input to the integrated circuit. However, in a case of increasing only the speed of the CLK, propagation delay of data in the counter 505 of the IC 502 needs to be taken into consideration. For example, a carry processing or borrow processing is needed in a counter when a carry or a borrow is propagated. When a 4-bit counter has a binary number "0111", incrementing the counter by one generates a carry in bit0, which is transferred to bit2. Additionally, a carry generated in bit1 is transferred to bit2, and a carry generated in bit2 is transferred to bit3, which results in a value of binary number "1000". As the number of occurrences of such propagation increases in proportion to the number of bits for the counter 505, the delay increases. These occurrences need to be within one CLK cycle. Thus, such a conventional configuration has the risk of failing to update data in time caused by the propagation delay in the counter 505 as a result of speeding up the CLK.

On the other hand, the reference voltage according to the present exemplary embodiment is configured as follows. FIG. 5 illustrates internal modules of the image control unit 1007 for obtaining the laser output control voltage Vrefl and the laser scanner unit 200 according to the present exemplary embodiment. An IC 512 includes a PWM signal generation unit 513 as an internal module thereof. The modules inside the broken line inside the IC 512, which is a pulse signal generation circuit, are a portion to operate in synchronization with a low-speed CLK while the rest of the IC 512 operates in synchronization with a high-speed CLK. The PWM signal generation unit 513 includes a register 514, a counter 515, a counter calculation unit 516, and a pattern generation unit 518. With these units, cycles of output PWM signals, ON times, OFF times can be set. The counter calculation unit 516 calculates a counter target value for the counter 515 and phase data to be used by the pattern generation unit 518 for generating a pulse pattern. The pattern generation unit 518 generates, for each low-speed CLK, a pulse pattern for outputting a PWM signal from a shift register 519 that functions as a parallel-serial conversion unit that executes parallel-serial conversion. The shift register 519 outputs pattern data output from the pattern generation unit 518 while shifting the pattern data by one bit. The shift register 519 operates in synchronization with a high-speed CLK output from the PLL circuit 517. More specifically, the PWM pattern data is input in parallel to the shift register 519 from the pattern generation unit 518 in synchronization with the low-speed CLK. The shift register 519 then serially outputs the data one bit in synchronization with the high-speed CLK. The low-speed CLK and the high-speed CLK are synchronized with each other. The cycle of PWM signal is set in the register 514 from a CPU 500. For example, when the register 514 is a 32-bit register, the higher order digit of n-bits are used for a count cycle in synchronization with the low-speed CLK while the lower order digit of m-bits are used for a pattern output cycle in synchronization with a high-speed CLK. In such a case, it is preferable that a relationship expressed by formula (1) is satisfied.

$$2^m = P, \tag{1}$$

where P denotes a multiplication factor for the PLL circuit 517.

An update cycle of a pattern from the pattern generation unit 518 is at least one CLK cycle of the low-speed CLK. However, the shift register 519 needs P CLK cycles of the high-speed CLK to completely output all pattern data received from the pattern generation unit 518. Therefore, a right amount of high-resolution PWM signal can be output when pattern data is generated for each cycle of the low-speed CLK.

Figure 6:
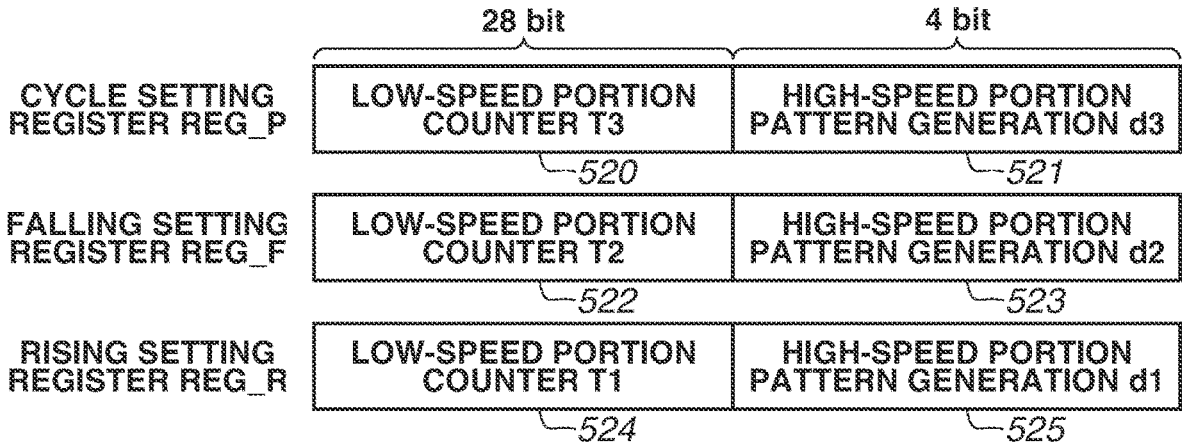
FIG. 6 is a diagram illustrating an example of a configuration of PWM output setting registers.

FIG. 6 illustrates a setting unit for the PWM output of the register 514. The register setting unit includes a cycle setting register REG_P (low-speed unit counter T3 520, high-speed unit counter d3 521), a falling setting register REG_F (low-speed unit counter T2 52, high-speed unit counter d2 523), and a rising setting register REG_R (low-speed unit counter T1 524, high-speed unit counter d1 525). Each of the setting registers is composed of 32 bits, among which the low 4 bits are used for high-speed part pattern generation. The high 28 bits are used as a timing counter counting based on the low-speed CLK. A high-resolution PWM pulse pattern is output when the output of each counter is compared and matched with the setting value. The bit widths of the register setting values described above are given as an example, and are not intended to limit the configurations of the registers.

Figure 7:
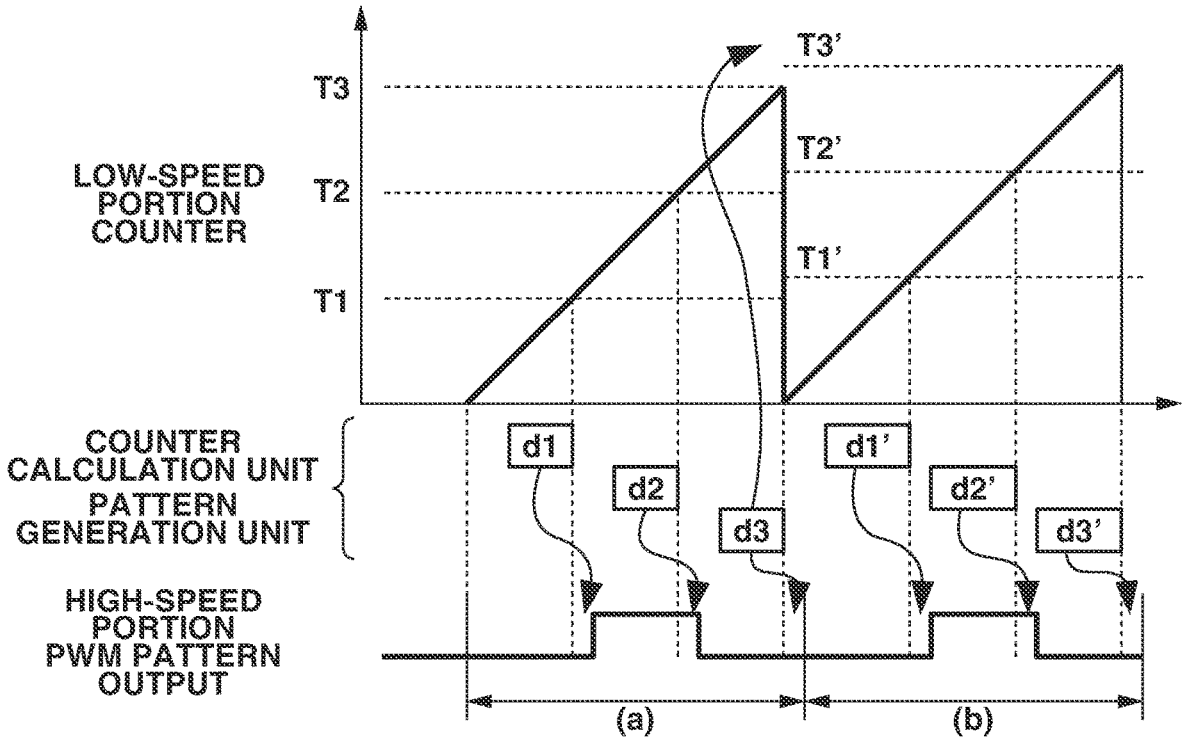
FIG. 7 is a timing chart of a low-speed clock part and a high-speed clock part.

FIG. 7 illustrates operation inside the PWM signal generation unit 513 until PWM output. The vertical axis represents the count value of the counter 515 of the low-speed portion counter. The horizontal axis represents time. Count Values T1 to T3 represent high/low (Hi/Lo) switching target values of a PWM signal. The counter calculation unit 516 calculates phase data d1 to d3 and d1' to d3' to be used for outputting a PWM signal with a resolution based on the high-speed CLK. At the timings of the count values T1 to T3, the pattern generation unit 518 outputs, to the shift register 519, PWM pulse pattern data in which the phase data is reflected. During each of the sections other than those timings, the pattern generation unit 518 outputs a pattern including only Hi or Lo. The counter calculation unit 516 calculates the counter target value with the phase data reflected in the counter target value for each PWM cycle. The phase data d3 in the first PWM section (a) is fraction data that cannot be counted by the low-speed CLK. Therefore, a value corresponding to the phase data d3 is added to the counter target value for the next PWM section (b), so that PWM cycles can be constant.

FIG. 8 illustrates a decoding table 530 contained in the pattern generation unit 518. The phase data d1 to d3 and d1' to d3' are converted into PWM pattern data. Based on this table, phase data of 4 bits is decoded into data (decoded data) phase data of 16 bits (a bit pattern that includes a plurality of pieces of bit data). For the sake of explanation, the table is assumed that a rising edge is output as a pulse one bit at a time in order from the low-order bit. Therefore, this example is not intended to limit the shape of the table.

Figure 9:
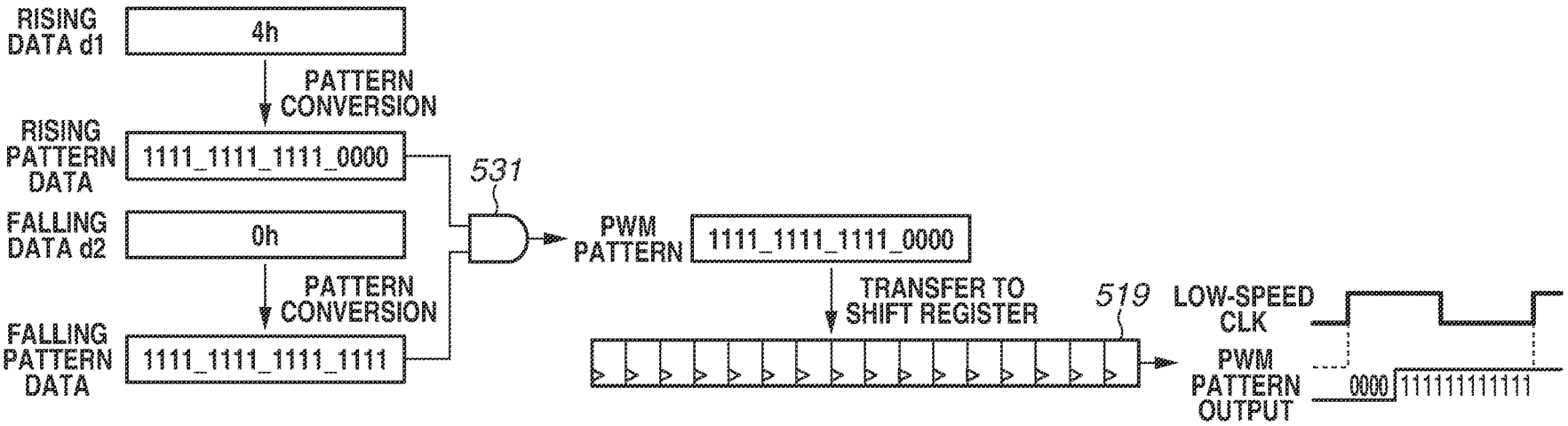
FIG. 9 is a block diagram illustrating a rising edge output.

FIG. 9 illustrates an internal process of the pattern generation unit 518. Specifically, FIG. 9 illustrates a process in which the rising phase data d1 (rising data) and the falling phase data d2 (falling data) are converted into pattern data from the decoding table 530 by the pattern generation unit 518 and are output to the shift register 519 as a PWM pattern. The description is given of, as an example, a case where, while the rising phase data d1 is 4-bit data and is 4 h in a hexadecimal form, and the falling phase data d2 is 0 h. Since the phase data d1 is 4 h, binary pattern data 1111_1111_1111_0000b is selected from the decoding table 530. Since the phase data d2 is 0 h, pattern data 1111_1111_1111_1111b is selected. This indicates that only a rising edge is present in one CLK cycle of the low-speed CLK. The selected phase data d1 and the phase data d2 are converted into PWM pattern data 1111_1111_1111_0000b by an AND gate 531, which is a logical operation element. The PWM pattern data (pulse pattern data) is stored in the shift register 519 and is output one bit at a time in order from the lowest-order bit in synchronization with the high-speed CLK. As a result, a high-resolution rising PWM signal can be obtained. In the following description, 16-bit data generated from the phase data d1 is referred to as first decoded data, and 16-bit data generated from the phase data d2 is referred to as second decoded data.

Figure 10:
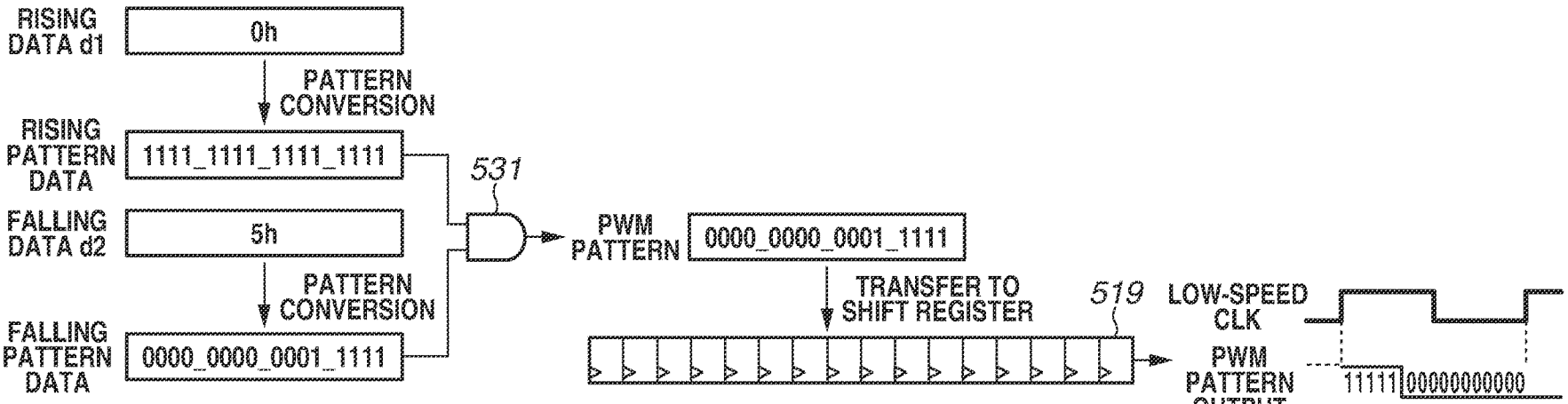
FIG. 10 is a block diagram illustrating a falling edge output.

FIG. 10 illustrates a case where only a falling edge is present in one CLK cycle of the low-speed CLK. The description is given of, as an example, a case where the rising phase data d1 (rising data) is 0 h, and the falling phase data d2 (falling data) is 5 h. Since the phase data d2 is 5 h, binary pattern data 1111_1111_1110_0000b is selected from the decoding table 530. Note that, when only one table is used as in the present exemplary embodiment, a falling timing and a pattern selected from the table are inverted. For that reason, when selected as falling data, pattern data in the decoding table 530 illustrated in FIG. 8 is used after the paten data is inverted. For example, the pattern generation unit 518 executes the process after inverting the pattern data 1111_1111_1110_0000b that corresponds to 5*h* in the decoding table 530, into pattern data 0000_0000_0001_1111b. Since the phase data d1 is 0 h, pattern data 1111_1111_1111_1111b is generated. The selected phase data d1 and the phase data d2 are converted into PWM pattern data 0000_0000_0001_1111b by the AND gate 531. The PWM pattern data is stored in the shift register 519 and is output one bit at a time in order from the lowest-order bit in synchronization with the high-speed CLK. As a result, a high-resolution falling PWM signal can be obtained. As a modification example, another decoding table obtained by inverting data in the decoding table 530 may be provided for falling phase data.

Figure 11:
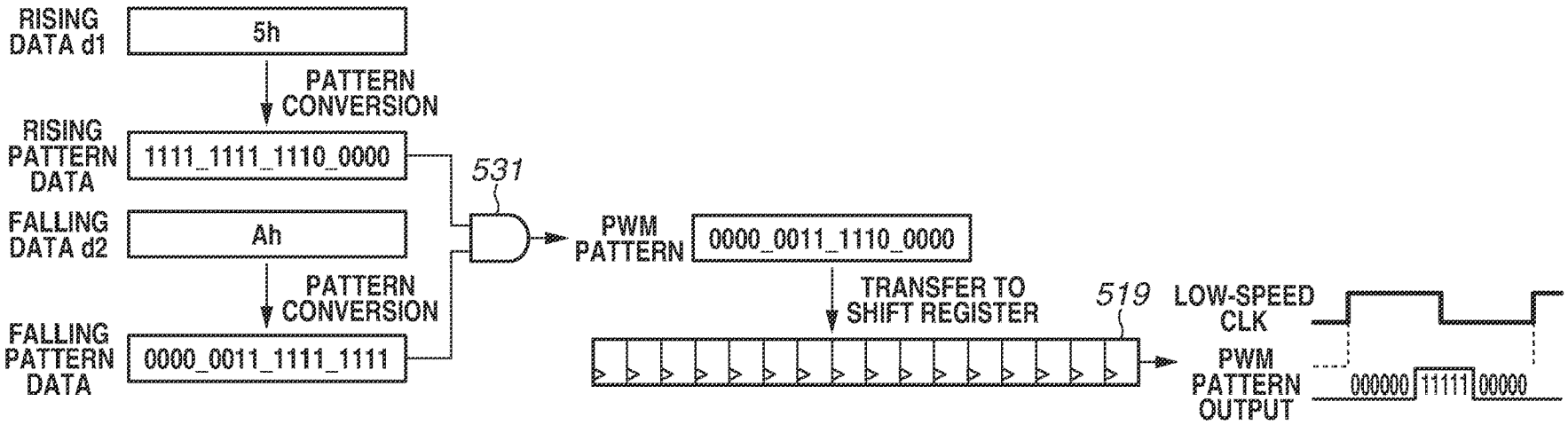
FIG. 11 is a block diagram illustrating a PWM signal having a convex waveform.

FIG. 11 illustrates a case of a convex waveform where a rising edge and a falling edge are present in one CLK cycle of the low-speed CLK. The description id given of, as an example, a case where the rising phase data d1 is 5 h, and the falling phase data d2 is Ah. Since the phase data d1 is 5 h, pattern data 1111_1111_1110_0000b is selected. Since the phase data d2 is Ah, binary pattern data 1111_1100_0000_0000b is selected from the decoding table 530. The selected phase data d1 and the phase data d2 are converted into PWM pattern data 0000_0011_1111_1111b by the AND gate 531. The PWM pattern data is stored in the shift register 519 and is output one bit at a time in order from the lowest-order bit in synchronization with the high-speed CLK. As a result, a high-resolution rising PWM signal can be obtained. As a modification example, another decoding table obtained by inverting data in the decoding table 530 may be provided for falling phase data.

Figure 12:
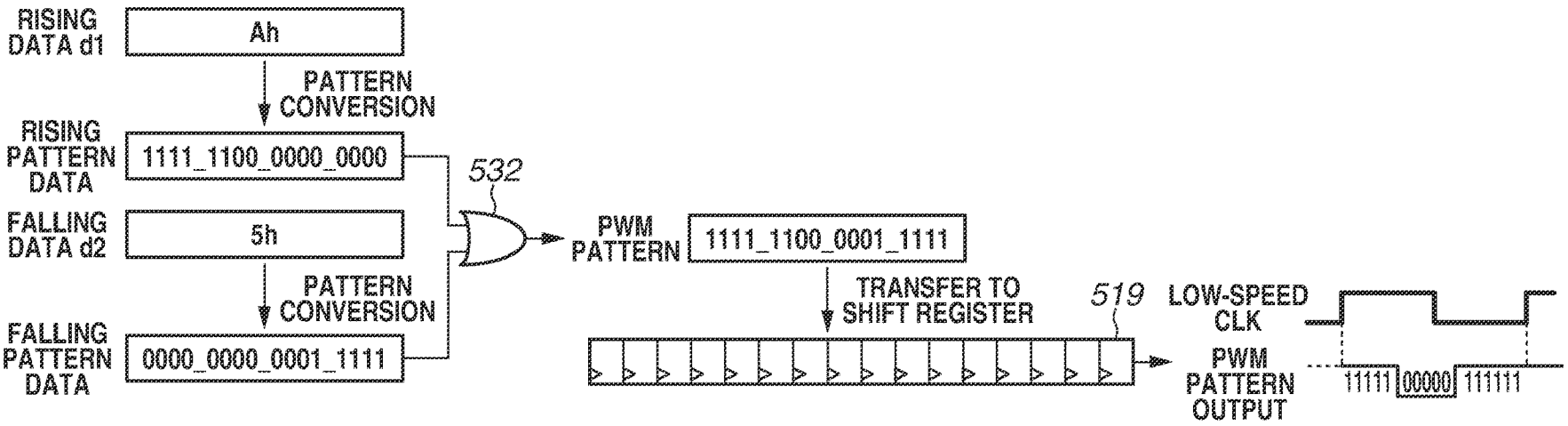
FIG. 12 is a block diagram illustrating a motor control configuration.

FIG. 12 illustrates a case of a concave waveform where a rising edge and a falling edge are present in one CLK cycle of the low-speed CLK. The description is given of, as an example, a case where the rising phase data d1 is Ah, and the falling phase data d2 is 5 h. Since the phase data d1 is Ah, pattern data 1111_1100_0000_0000b is selected. Since the phase data d2 is 5 h, a binary number 1111_1111_1110_0000b is selected from the decoding table 530. Accordingly, "0000_0000_0001_1111b" is selected as pattern data for the phase data d2. To obtain a concave waveform, the selected phase data d1 and the phase data d2 are converted into PWM pattern data 1111_1100_0001_1111b by an OR gate 532, which is a logical operation element. A condition under which the pattern generation unit 518 selects the OR gate 532 instead of the AND gate 531 is "the rising phase data d1>the falling phase data d2" or "the rising phase data d1'>the falling phase data d2'".

The PWM pattern data is stored in the shift register 519 and is output one bit at a time in order from the lowest-order bit in synchronization with the high-speed CLK. As a result, a high-resolution rising PWM pattern having a concave waveform can be obtained.

As described above, counting up and phase data calculation are performed based on the low-speed CLK, whereby the influence of data propagation delay due to occurrence of carries can be suppressed. In addition, when a pattern is generated, phase data are converted into pattern data from a table and subjected to a process by a logical gate, whereby calculation of carries is excluded and the influence of data propagation delay due to occurrence of carries can be suppressed. This method enables high-resolution PWM output. As a result, the present configuration enables PWM output with a resolution of 320 MHz while the resolution of PWM output according to the conventional configuration in FIG. 4 has the upper limit of 200 MHz.

A PWM signal is a digital signal in which a Hi level and a Lo level are repeated. The LPF 602 is used for making this signal constant. It is preferably that a constant to be used in the LPF 602 is set so that the relationship between a PWM frequency to be output and a cutoff frequency fc satisfy formula (2).

$$fc<\text{fpwm}, \quad (2)$$

where fpwm denotes the PWM frequency.

When the condition expressed by formula (2) is satisfied, voltage ripples of the laser output control voltage Vrefl after passing the LPF 602 can be suppressed.

As described above, even when the process speed of the image forming apparatus 100 is increased, PWM output with a higher resolution can be obtained as a result of separating the PWM signal generation unit 513 into a region that operates in synchronization with a low-speed CLK and the shift register 519 that operates in synchronization with a high-speed CLK. As a result, the laser output control voltage Vrefl having a resolution required for shading correction can be obtained.

The laser output control voltage Vrefl is smoothed by the LPF 602, and the reference voltage obtained through the smoothing acts on the laser driver 1008 included in the laser scanner unit 200. More specifically, in the shading correction, the laser output control voltage Vrefl is converted corresponding to exposure positions of laser light in the main scanning direction, and the value of electric current supplied to the laser light source 1000 from the laser driver 1008 changes accordingly, so that the amount of laser light is connected.

Figure 13:
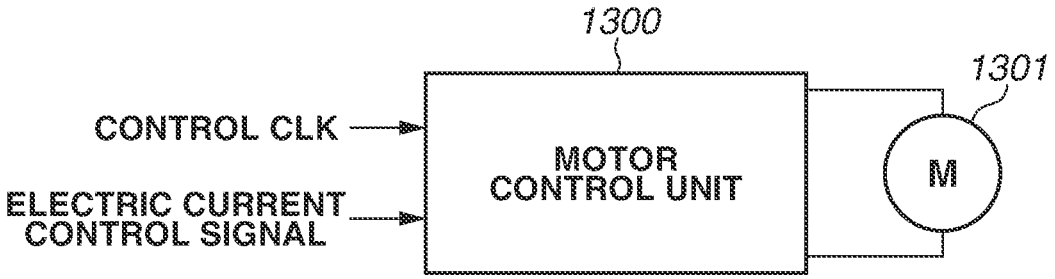
FIG. 13 is a block diagram illustrating a control clock (CLK) frequency and a motor current.
Figure 14:
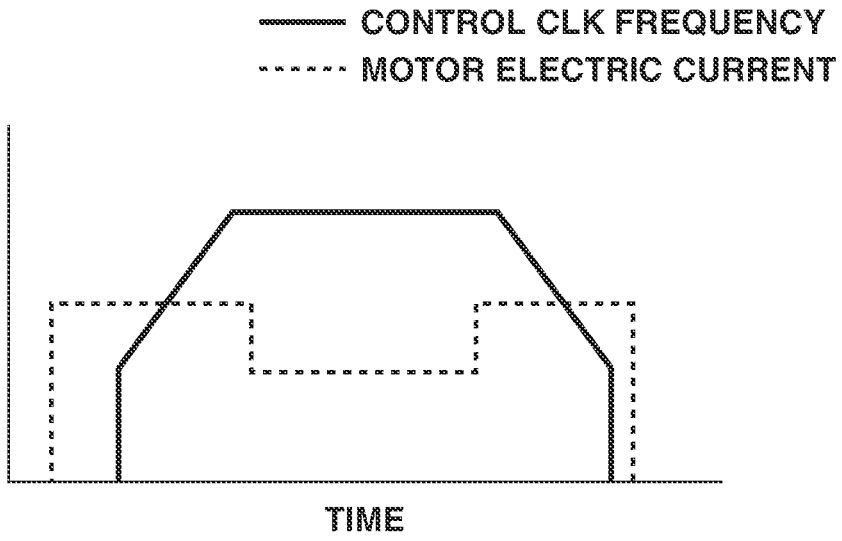
FIG. 14 is a graph illustrating a configuration using a PWM output as an electric current control signal.
Figure 15:
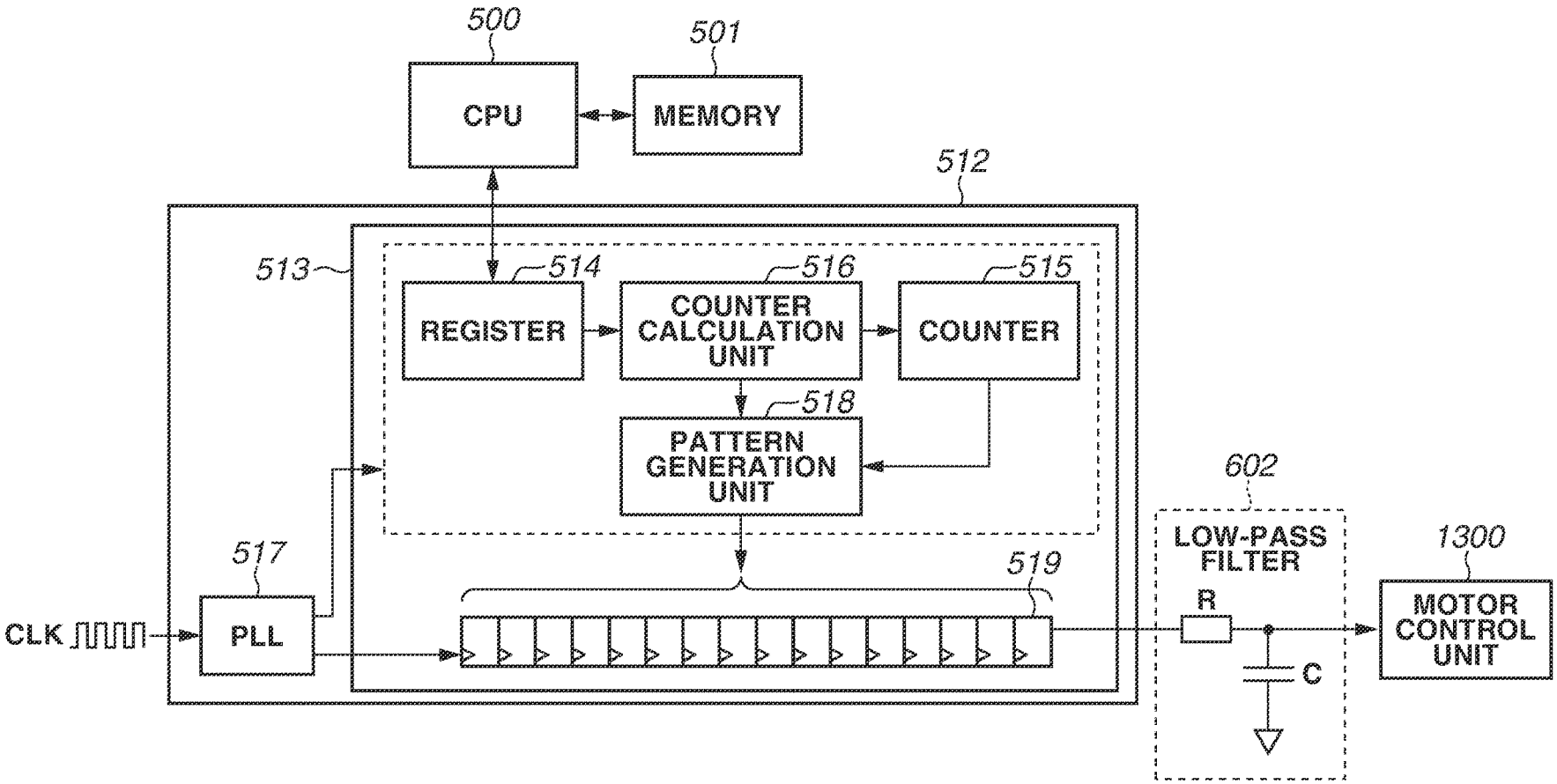
FIG. 15 is a block diagram illustrating a PWM waveform and a ripple voltage.

FIG. 13 illustrates a configuration of a motor control unit according to a second exemplary embodiment. The present exemplary embodiment is described by using control of a stepping motor as an example. The stepping motor 1301 is used for each drive unit in the image forming apparatus 100. To control the stepping motor 1301, a control CLK signal for controlling motor steps and an electric current control signal for controlling electric current that flows into the motor are used. In a stepping motor, a motor shaft is rotated so as to rotate in units of step angles in synchronization with a control UK input to a motor control unit. The electric current that flows into the motor is adjusted by the motor control unit 1300 based on the electric current control signal so as to obtain a required torque. When the stepping motor 1301 is rotated, appropriate electric current needs to flow into the stepping motor 1301. An insufficient amount of electric current may cause the stepping motor 1301 to lose steps and stop rotating. An excessive amount of electric current may generate a high amount of heat or cause vibration. FIG. 14 illustrates a relationship between a control CLK frequency and a motor current for the stepping motor 1301. When the stepping motor 1301 is accelerated or decelerated, the electric current needs to increase because the torque acting thereon increases. When the stepping motor 1301 is making steady rotating movement, the electric current can decrease because the torque for acceleration or deceleration is not needed.

In the present exemplary embodiment, the PWM signal generation unit 513 described in the first exemplary embodiment is used as a circuit that generates an electric current control signal Vrefm. Regarding PWM signal output, the same description as in the first exemplary embodiment is applicable.

The stepping motor 1301 used in the image forming apparatus 100 repeats rotating and stopping while a job is executed. Rotation of the stepping motor 1301 is controlled by the CPU 500, which is determined based on a state of a sensor signal or the like while a sheet is conveyed. Depending on the state of a sensor signal, the stepping motor 1301 needs to be immediately stopped. In this case, the electric current needs to be set in an extremely short time period when the motor is stopped. The response time of the electric current control signal Vrefm is dependent on the output cycle of PWM signal and the LPF 602. When the time constant of the LPF 602 is large, the response time becomes long. When the time constant of the LPF 602 is small, the tipple voltage of the PWM signal becomes large and stable electric current cannot be supplied, which may cause the stepping motor 1301 to lose steps.

Figure 16:
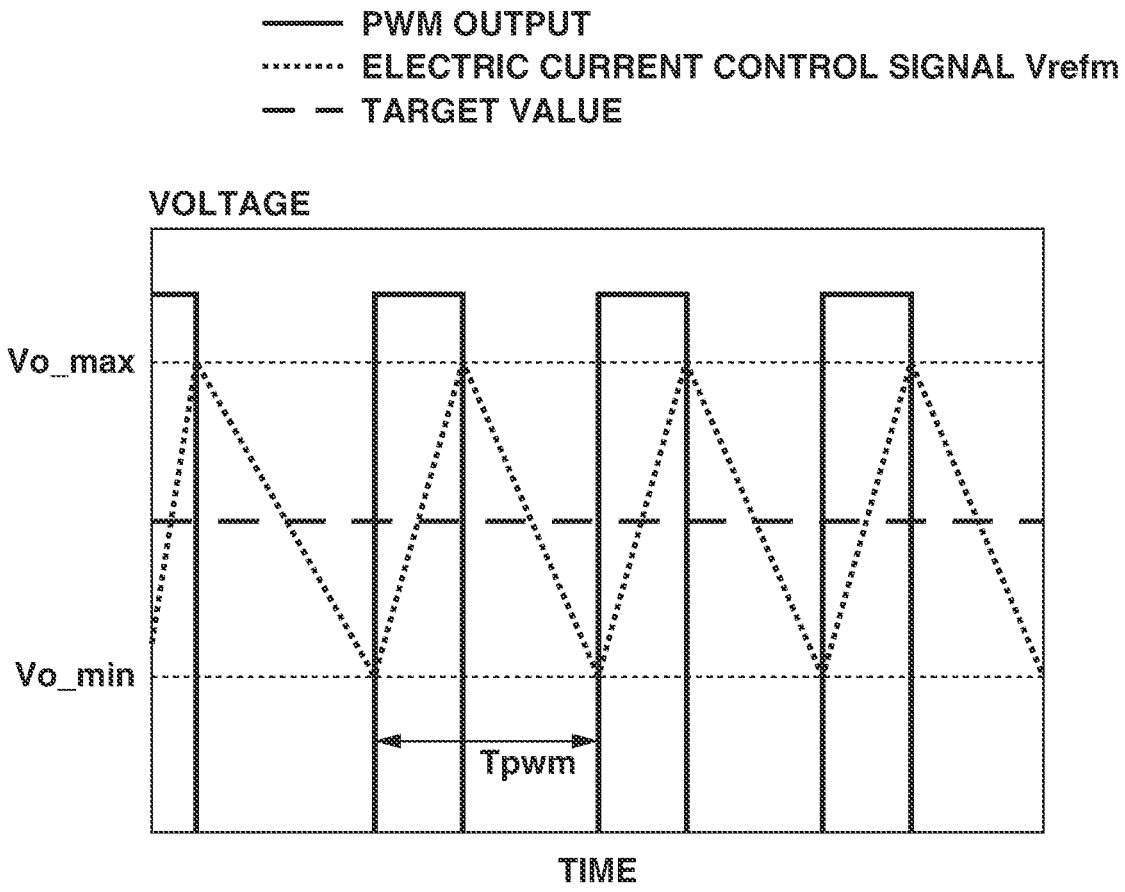
FIG. 16 is a graph illustrating responsiveness of the electric current control signal.

FIG. 16 illustrates output of the PWM signal and the ripple voltage of the electric current control signal Vrefm. The maximum value Vo_max and the minimum value Vo_min of the electric current control signal Vrefm are dependent on a PWM output cycle Tpwm and the time constant of the filter. When the resolution of PWM output is not high, the electric current set based on the electric current control signal Vrefm becomes rough, so that there arises the need to flow excessive electric current. Thus, PWM signal output has preferably higher resolution.

Figure 17:
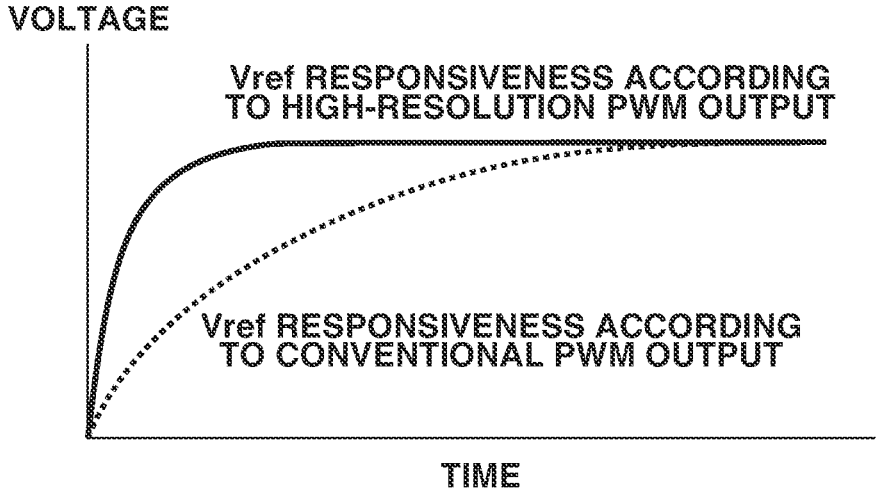
FIG. 17 is a graph illustrating an example of a configuration for high-voltage control.

FIG. 17 illustrates responses in cases where filters for suppressing ripple voltages of the electric current control signal Vrefm within the same level are set in high-resolution PWM signal output and in conventional PWM signal output. To improve the responsiveness and suppress the ripple voltage to a certain level, the output frequency of PWM signals need to be increased corresponding to a degree the time constant of each filter is reduced. For example, when the time constant is reduced by half, the frequency needs to be doubled.

Even in this case, a PWM signal with a higher resolution can be obtained as a result of separating the PWM signal generation unit 513 into a region that operates in synchronization with a low-speed. CLK and the shift register 519 that operates in synchronization with a high-speed CLK. As a result, the resolution of the electric current control signal Vrefm can be obtained.

Figure 18:
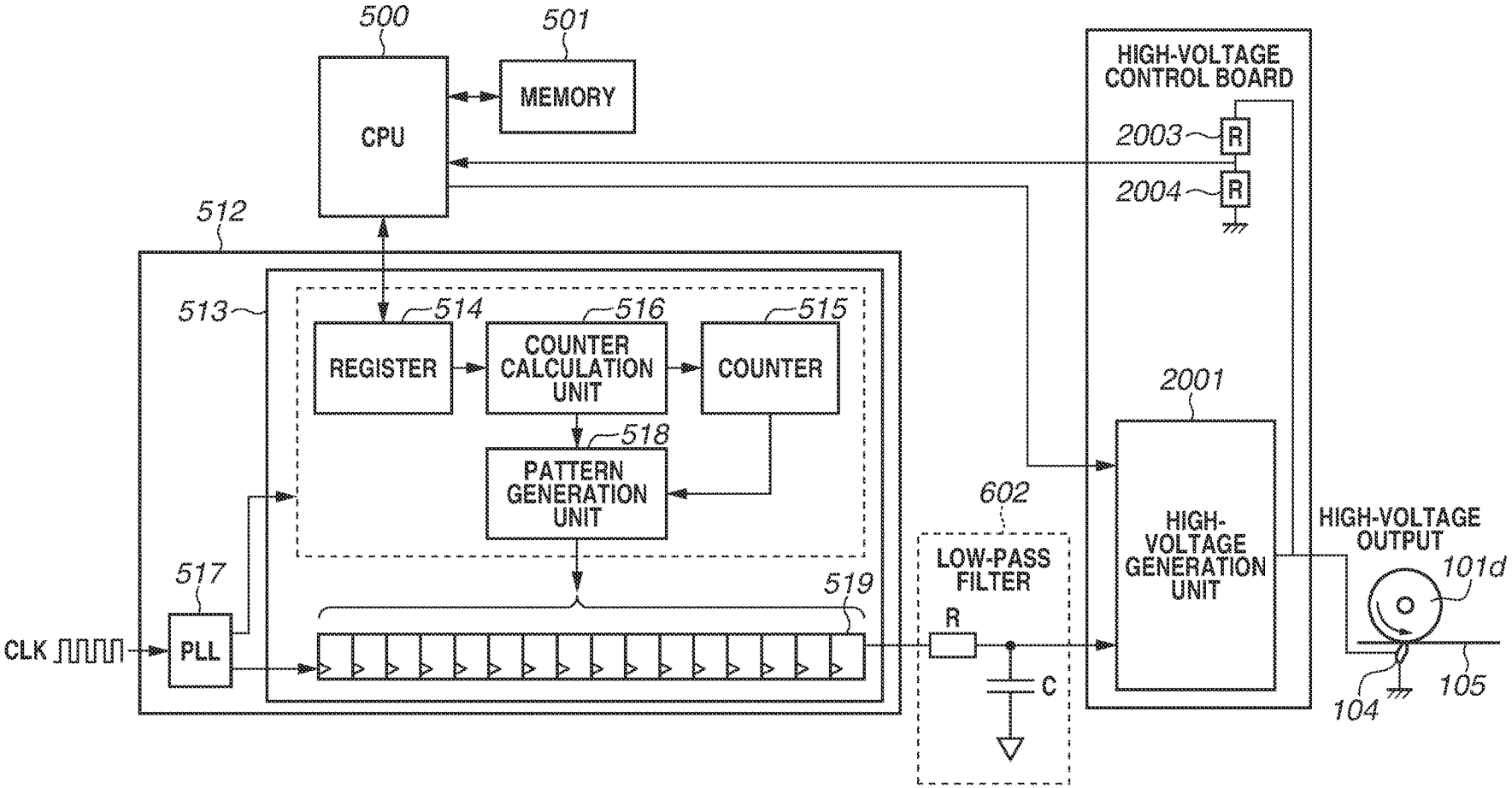
FIG. 18 is a block diagram illustrating a configuration of a primary transfer high-voltage part.

FIG. 18 illustrates a configuration of a primary transfer high-voltage portion according to a third exemplary embodiment. The respective toner images of the colors developed on the photosensitive drums 101 are transferred onto the intermediate transfer belt 105 with transfer biases applied to the transfer blades 104. In FIG. 18, a high-voltage control CLK is output from the CPU 500 to drive a high-voltage transformer in the high voltage generation unit 2001. In addition, high-voltage output voltage is controlled by using high-voltage reference voltage Vrevh obtained by the LPF 602 smoothing the PWM signal. The transfer bias voltage is divided by resistances 2003 and 2004 and fed back to AD input of the CPU 500, so that the high-voltage reference voltage Vref is adjusted. In the present exemplary embodiment, the CPU 500 outputs the high-voltage control CLK and has the transfer bias voltage fed back thereto. However, it is not limited thereto.

In high-voltage control, the density non-uniformity of an image may be caused by the low accuracy of the pulse width of a PWM signal. For example, if the high-voltage reference voltage Vrefh is large when a PWM signal is shifted by one step as a result of feeding back the transfer bias, a color on the image changes when the control is switched. This degrades the quality of the image. For that reason, the pulse width of a PWM signal needs to be controlled with a high resolution. In the configuration according to the present exemplary embodiment, a PWM signal is used as the high-voltage reference voltage Vrefh. Regarding a method for generating a PWM signal, the same description as in the first exemplary embodiment is applicable.

Even in this case, a PWM signal with a higher resolution can be generated as a result of separating the PWM signal generation unit 513 into a region that operates in synchronization with a low-speed. CLK and the shift register 519 that operates in synchronization with a high-speed CLK. As a result, the resolution for controlling the high-voltage reference voltage Vrefh can be improved.

According to the above-described exemplary embodiments, a pulse signal can be generated by generating pattern data by performing a logical operation on rising data that indicates rising of a pulse signal and falling data that indicates falling of the pulse signal.

While exemplary embodiments have been described, it is to be understood that the invention is not limited to the disclosed exemplary embodiments. The scope of the following claims is to be accorded the broadest interpretation so as to encompass all such modifications and equivalent: structures and functions.

This application claims the benefit of Japanese Patent Application No. 2019-007378, filed Jan. 18, 2019, which is hereby incorporated by reference herein in its entirety.

What is claimed is:

1. A pulse signal generation circuit that generates a pulse signal, the pulse signal generation circuit comprising:

a pattern generation unit configured to generate, as a first bit pattern, rising data, indicating rising of the pulse signal, and falling data, indicating falling of the pulse signal, wherein each of the rising data and the falling data of the first bit pattern includes a plurality of pieces of bit data, and generate a second bit pattern, including a plurality of pieces of bit data, by performing a logical operation using the rising data and the falling data;

a clock signal generation unit configured to generate a clock signal; and a shift register configured to have the second bit pattern set therein, the second bit pattern generated by the pattern generation unit, wherein the pulse signal is generated by the shift register outputting pattern data of the second bit pattern, one bit at a time in synchronization with the clock signal.

2. An image forming apparatus including the pulse signal generation circuit according to claim 1, comprising:

the pulse signal generation circuit according to claim 1; and a smoothing circuit configured to smooth the pulse signal to generate a reference voltage.

3. The image forming apparatus according to claim 2, further comprising:

a laser light source configured to emit laser light; and a laser driver configured to supply electric current to the laser light source, wherein the reference voltage acts on the laser driver, and a value of the electric current supplied to the laser light source from the laser driver is changed based on the reference voltage acting on the laser driver.

* * * * *